US011965506B2

(12) United States Patent
Loehmer et al.

(10) Patent No.: US 11,965,506 B2
(45) Date of Patent: Apr. 23, 2024

(54) SPIRAL COMPRESSOR

(71) Applicant: PIERBURG GMBH, Neuss (DE)

(72) Inventors: Lukas Loehmer, Duesseldorf (DE); Philipp Barth, Wetter (DE); Jan Berwanger, Stolberg (DE)

(73) Assignee: PIERBURG GMBH, Neuss (DE)

( * ) Notice: Subject to any disclaimer, the term of this patent is extended or adjusted under 35 U.S.C. 154(b) by 141 days.

(21) Appl. No.: 17/791,217

(22) PCT Filed: Jan. 9, 2020

(86) PCT No.: PCT/EP2020/050435

§ 371 (c)(1),
(2) Date: Jul. 7, 2022

(87) PCT Pub. No.: WO2021/139890

PCT Pub. Date: Jul. 15, 2021

(65) Prior Publication Data

US 2023/0349379 A1 Nov. 2, 2023

(51) Int. Cl.

| | |
|---|---|
| ***F04C 29/02*** | (2006.01) |
| ***F04C 18/02*** | (2006.01) |
| ***F04C 23/02*** | (2006.01) |

(52) U.S. Cl.

CPC ..... *F04C 18/0215* (2013.01); *F04C 23/02* (2013.01); *F04C 29/026* (2013.01); *F04C 2240/30* (2013.01); *F04C 2240/40* (2013.01)

(58) Field of Classification Search

CPC .... F04C 18/0215; F04C 23/02; F04C 29/026; F04C 29/028

See application file for complete search history.

(56) References Cited

U.S. PATENT DOCUMENTS

| | | | | |
|---|---|---|---|---|
| 7,101,160 | B2 * | 9/2006 | Gennami | F04C 29/02 418/55.6 |
| 9,360,012 | B2 * | 6/2016 | Yamashita | F04C 27/005 |
| 10,094,379 | B2 * | 10/2018 | Won | F04C 27/005 |
| 11,131,306 | B2 * | 9/2021 | Obrist | F04C 18/0215 |

(Continued)

FOREIGN PATENT DOCUMENTS

| | | |
|---|---|---|
| DE | 10 2013 226 590 A1 | 6/2014 |
| EP | 1 464 841 A1 | 10/2004 |
| EP | 3 404 264 A1 | 11/2018 |

*Primary Examiner* — Sabbir Hasan
(74) *Attorney, Agent, or Firm* — Norman B. Thot

(57) ABSTRACT

A scroll compressor includes a compressor housing, a high-pressure chamber, a low-pressure chamber, an oil return channel having an oil return throttle arranged therein, a driven eccentric unit, a fixed scroll, an orbiting displacement scroll arranged on the driven eccentric unit which interacts with the fixed scroll, a sliding disk arranged between the orbiting displacement scroll and the compressor housing, a back-pressure chamber arranged adjacent to the orbiting displacement scroll, and a gas connecting channel having a gas connecting throttle arranged therein. The oil return channel fluidically connects the high-pressure chamber with the low-pressure chamber. The gas connecting channel fluidically connects the back-pressure chamber with the high-pressure chamber. The oil return channel and/or the gas connecting channel extends through the sliding disk. The sliding disk includes the oil return throttle and/or the gas connecting throttle.

14 Claims, 2 Drawing Sheets

(56) References Cited

U.S. PATENT DOCUMENTS

| | | | | |
|---|---|---|---|---|
| 2004/0191083 | A1 | 9/2004 | Gennami et al. | |
| 2014/0178232 | A1 | 6/2014 | Nagano et al. | |
| 2018/0258933 | A1* | 9/2018 | Obrist | F04C 18/0215 |
| 2018/0335032 | A1 | 11/2018 | Obrist et al. | |

* cited by examiner

SPIRAL COMPRESSOR

CROSS REFERENCE TO PRIOR APPLICATIONS

This application is a U.S. National Phase application under 35 U.S.C. § 371 of International Application No. PCT/EP2020/050435, filed on Jan. 9, 2020. The International Application was published in German on Jul. 15, 2021 as WO 2021/139890 A1 under PCT Article 21(2).

FIELD

The present invention relates to a spiral compressor, which is hereinafter referred to as a scroll compressor, with a compressor housing, a high-pressure chamber, a low-pressure chamber which is fluidically connected to the high-pressure chamber via an oil return channel, wherein an oil return throttle is provided in the oil return channel, an orbiting displacement scroll arranged on a driven and orbiting eccentric unit, which interacts with a fixed scroll, wherein a sliding disk is provided between the orbiting displacement scroll and the compressor housing, and a back pressure chamber adjacent to the displacement scroll, which is fluidically connected to the high-pressure chamber via a gas connecting channel, wherein a gas connecting throttle is provided in the gas connecting channel.

BACKGROUND

Such scroll compressors have previously been described in the prior art, for example, in EP 3 404 264 A1, and comprise a high-pressure chamber, a low-pressure chamber, an orbiting displacement scroll, and a fixed scroll cooperating with the displacement scroll. A sliding disk is arranged between the orbiting displacement scroll and a compressor housing. The orbiting displacement scroll interacts with the fixed scroll so that compression chambers are formed between the displacement scroll and the fixed scroll, which receive a working fluid. A back-pressure chamber is provided between the compressor housing and the displacement scroll. The pressure existing in the back-pressure chamber and acting on the displacement scroll causes a resultant force in the axial direction, whereby the displacement scroll is pressed against the fixed scroll and the scrolls are thus sealed off from each other.

The existing pressure in the back pressure chamber is built up by a fluidic connection between the back-pressure chamber and the high-pressure chamber, wherein the high-pressure fluid flows into the back pressure chamber via a gas connecting channel which connects the high-pressure chamber with the back-pressure chamber. A gas connecting throttle is arranged in the gas connecting channel, which controls the mass flow of the fluid flowing into the back-pressure chamber. A disadvantage of such a gas connecting throttle is that it is formed by a separate component, so that the use of such a separate gas connecting throttle increases the manufacturing as well as the assembly costs of the scroll compressor.

The scroll compressor also comprises an oil return channel which fluidically connects the high-pressure chamber with the low-pressure chamber. An oil which is provided for lubricating the components in the scroll compressor is separated from the compressed fluid via a separator arranged in the high-pressure chamber and returned to the low-pressure chamber via the oil return channel, so that the returned oil can be reused for lubricating the components.

An oil return throttle is arranged in the oil return channel to control the return mass flow of the separated oil. The oil return throttle is formed by a separate component, which must be manufactured by an additional manufacturing process and must be mounted elaborately into the oil return channel during the mounting, thus increasing the manufacturing and mounting effort of the scroll compressor.

SUMMARY

An aspect of the present invention is to provide a scroll compressor which has a reduced manufacturing and assembly effort.

In an embodiment, the present invention provides a scroll compressor which includes a compressor housing, a high-pressure chamber, a low-pressure chamber, an oil return channel comprising an oil return throttle arranged therein, a driven eccentric unit, a fixed scroll, an orbiting displacement scroll arranged on the driven eccentric unit which interacts with the fixed scroll, a sliding disk arranged between the orbiting displacement scroll and the compressor housing, a back-pressure chamber arranged adjacent to the orbiting displacement scroll, and a gas connecting channel comprising a gas connecting throttle arranged therein. The oil return channel is configured to fluidically connect the high-pressure chamber with the low-pressure chamber. The gas connecting channel is configured to fluidically connect the back-pressure chamber with the high-pressure chamber. At least one of the oil return channel and the gas connecting channel extends through the sliding disk. The sliding disk comprises at least one of the oil return throttle and the gas connecting throttle.

BRIEF DESCRIPTION OF THE DRAWINGS

The present invention is described in greater detail below on the basis of embodiments and of the drawings in which.

DETAILED DESCRIPTION

Figure 1:
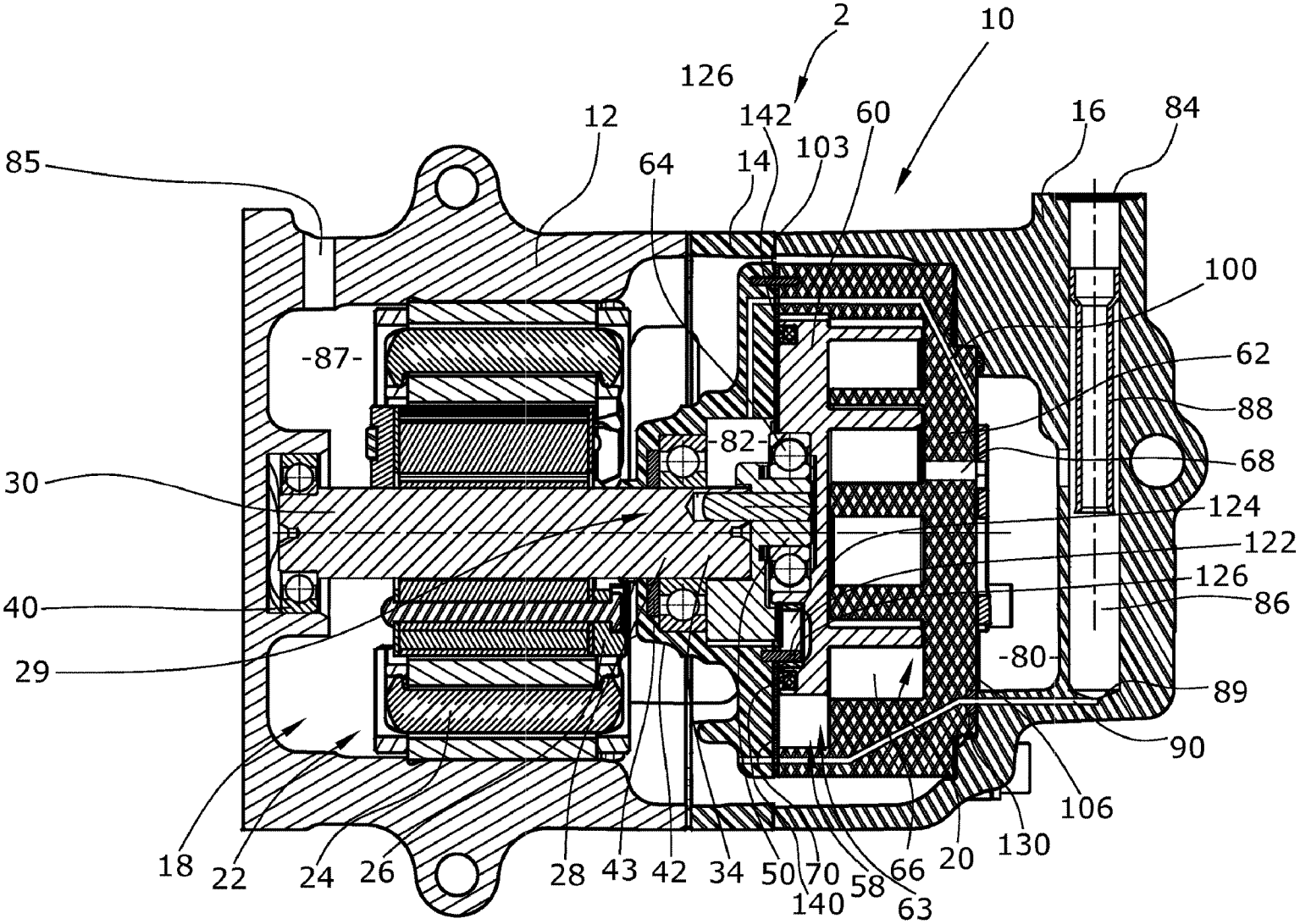
FIG. 1 shows a sectional view of a scroll compressor according to the present invention.

In that the oil return channel and/or the gas connecting channel extend through the sliding disk, wherein the sliding disk comprises the oil return throttle and/or the gas connecting throttle, the manufacturing and the assembly of the scroll compressor is simplified and the manufacturing and assembly costs are thereby reduced. The sliding disk in this case assumes the throttle function in the oil return channel and/or in the gas connecting channel, wherein the oil return throttle or the gas connecting throttle is designed via a simply and inexpensively manufactured opening in the sliding disk, and no additional components are required to provide the oil return throttle and/or the gas connecting throttle. The sliding disc thus achieves the reduced sliding friction between the orbiting displacement scroll and the compressor housing as well as the throttling of the fluid flowing into the back-pressure chamber and/or the oil flowing back into the low-pressure chamber.

In an embodiment of the present invention, the oil return throttle or the gas connecting throttle can, for example, be an orifice provided on the sliding disk, wherein the orifice comprises a smaller diameter than the oil return channel or the gas connecting channel. The sliding disk can thereby be provided with the oil return throttle and/or the gas connection throttle in a simple and inexpensive manner, wherein such a throttle can be manufactured by a simple and inexpensive manufacturing process, for example, with a laser. A throttle for the oil return channel and/or for the gas connecting channel is thus created, wherein no additional components, which would increase the manufacturing and assembly costs, are required.

In an embodiment of the present invention, the oil return channel and/or the gas connecting channel can, for example, extend at least in sections through the fixed scroll. In an embodiment of the present invention, the gas connecting channel can, for example, extend from the high-pressure chamber via a gas channel in the fixed scroll, through the sliding disk, and, via a gas channel in the compressor housing, to the back-pressure chamber. In an embodiment of the present invention, the oil return channel can, for example, extend from the high-pressure chamber via an oil channel in the fixed scroll, through the sliding disk, and, via an oil channel in the compressor housing, to the low-pressure chamber.

Because the sliding disk is directly adjacent to the fixed scroll and the fixed scroll is directly adjacent to the back-pressure chamber, the oil return channel and/or the gas connecting channel can be guided in a direct manner from the high-pressure chamber to the back-pressure chamber or the low-pressure chamber.

In an embodiment of the present invention, the high-pressure chamber can, for example, comprise an oil separation chamber in which an oil separator is arranged, wherein an inlet of the oil return duct is arranged at the lowest point of the oil separation chamber. The oil separator separates the oil dissolved in the gas, wherein the oil-free gas rises and flows through an outlet into a cooling circuit. The separated oil drops to the bottom of the oil separation chamber and flows back into the low-pressure chamber via the oil return channel. The oil can be used to lubricate the components of the scroll compressor.

In an embodiment of the present invention, an inlet of the gas connecting channel can, for example, be arranged upstream of the oil separator in the direction of flow of the gas-oil mixture. The gas with oil dissolved therein is thereby conveyed into the back-pressure chamber, whereby the components adjacent to the back-pressure chamber, and in particular bearing elements, are lubricated by the oil. The inlet of the gas connecting channel can alternatively be arranged downstream of the oil separator in the direction of flow of the gas-oil mixture.

In an embodiment of the present invention, a filter can, for example, be provided in the oil return channel and/or gas connecting channel. Particles can be contained in the returning oil and/or in the gas flowing into the back-pressure chamber, the particles being caused, for example, by wear of the components moving in relation to each other. The particles can lead to a blocking of the oil return throttle or the gas connection throttle or to an abrasive wear of the components moving relative to each other. The filter can be used to filter the particles out of the oil or gas and to prevent a blocking of the oil recirculation channel or the gas connecting channel and an abrasive wear of the components moving relative to each other.

In an embodiment of the present invention, the displacement scroll can, for example, comprise a circumferential groove on the side facing the sliding disk in which a sliding ring is arranged, wherein the sliding ring is in contact with the sliding disk. The friction between the sliding disk and the displacement scroll can thus be reduced during the orbiting movement of the displacement scroll.

In an embodiment of the present invention, the sliding disc can, for example, be interlockingly connected to the compressor housing perpendicular to a longitudinal axis. In an embodiment of the present invention, the compressor housing can, for example, comprise at least one fixing pin and the sliding disk can, for example, comprise a fixing hole corresponding to the fixing pin. The fixing pin can reliably prevent a twisting and a radial displacement of the sliding disk. The fixing pin can be a separate component which is pressed into an orifice of the compressor housing or be manufactured in one piece with the compressor housing.

In an embodiment of the present invention, the sliding disc can, for example, comprise at least one guide opening through which a guide pin which is attached to the compressor housing and which guides the orbiting displacement scroll extends. The guide pin eccentrically interacts with an orifice in the displacement scroll, whereby the displacement scroll is guided by the guide pin during an orbiting motion, wherein a rotational motion of the displacement scroll is prevented by the guide pin.

In an embodiment of the present invention, the oil return throttle and/or the gas connection throttle can, for example, comprise a diameter which is many times smaller than the diameter of the fixing pin or the guide pin. The size of the diameter of the oil return throttle and/or the gas connection throttle can control the oil or gas mass flow.

In an embodiment of the present invention, the orbiting displacement scroll can, for example, be connected to a rotor shaft of a rotor of an electric motor via the eccentric unit, wherein the electric motor is arranged in the low-pressure chamber. Arranging the electric motor in the low-pressure chamber cools the electric motor and thereby increases the lifetime of the scroll compressor.

A scroll compressor for an air-conditioning system of a motor vehicle is thus provided which comprises a gas connecting channel extending from the high-pressure chamber to the back-pressure chamber and/or an oil return throttle extending from the high-pressure chamber to the low-pressure chamber, wherein a gas connecting throttle arranged in the gas connecting channel and/or an oil return throttle arranged in the oil return channel is provided in a simple and inexpensive manner by the sliding disc, and wherein the assembly and manufacturing costs of the scroll compressor are reduced.

An example of a scroll compressor according to the present invention is described below with reference to the attached drawings.

The scroll compressor 2 comprises a multi-part compressor housing 10 with a first compressor housing part 12, a second compressor housing part 14 axially adjoining the first compressor housing part 12, and a third compressor housing part 16 adjoining the second compressor housing part 14. The first compressor housing part 12, the second compressor housing part 14, and the third compressor housing part 16 define a motor chamber 18. The second compressor housing part 14 and the third compressor housing part 16 define a compressor chamber 20.

In the motor chamber 18, an electric motor 22 is arranged with a stator 24 and a rotor 26. The rotor 26 is mounted on a rotor shaft 28. The rotor shaft 28 extends from the motor chamber 18 through a central orifice 29 of the second compressor housing part 14 into the compressor chamber 20. The rotor shaft 28 is mounted rotatably about a rotor shaft rotation axis in two shaft bearings 40, 42 via two end shaft bearing sections 30, 34. The first shaft bearing 40 is arranged in the motor chamber 18 and supports the first end shaft bearing section 30. The second shaft bearing 42 is arranged in the compressor compartment 20 and supports the second end shaft bearing section 34. On the side of the second shaft bearing 42 facing the motor chamber 18, a shaft ring 43 is provided which is in contact with the rotor shaft 28 on the radially inner side and is supported on the radially outer side by the second compressor housing part 14. The shaft ring 43 fluidically seals the motor chamber 18 from a back-pressure chamber 82 of the compressor chamber 20.

A compressor unit 58 is arranged in the compressor chamber 20, which comprises an orbiting displacement scroll 60 and a fixed scroll 62. The orbiting displacement scroll 60 is arranged on an eccentric unit 50 attached to the rotor shaft 28 via an eccentric shaft bearing 64 and is in contact with a surface of the second compressor housing part 14 facing the compressor chamber 20 via a sliding disk 70, wherein the displacement scroll 60 comprises a sliding ring 142 arranged in a circumferential groove 140 on the side facing the sliding disk 70.

The fixed scroll 62 is fixed to the compressor housing 10, wherein the fixed scroll 62 is axially supported by the second compressor housing part 14 and the third compressor housing part 16.

In the operation of the scroll compressor 2, a refrigerant is introduced into the motor chamber 18 of the scroll compressor 2 through a compressor inlet 85, wherein the refrigerant flows through the motor chamber 18 into the compressor chamber 20. Rotation of the rotor shaft 28, and hence the eccentric unit 50, about the rotor axis of rotation produces an orbiting motion of the orbiting displacement scroll 60. The orbiting displacement scroll 60 and the fixed scroll 62 are configured to define a compression chamber 63, and the orbiting motion of the orbiting displacement scroll 60 causes the refrigerant to be delivered from a radially outer inlet 66 of the compression chamber 63 to a radially inner outlet 68 of the compression chamber 63, thereby compressing the refrigerant.

The compressor chamber 20 comprises a high-pressure chamber 80 and a back-pressure chamber 82. The high-pressure chamber 80 is defined by the third compressor housing part 16 and by the fixed scroll 62, and is fluidically arranged between the radially inner outlet 68 and a compressor outlet 84, wherein the refrigerant flows from the radially inner outlet 68 via the high-pressure chamber 80 to the compressor outlet 84. From the compressor outlet 84, the refrigerant flows into a coolant circuit of a motor vehicle. The high-pressure chamber 80 comprises an oil separation chamber 86, which is fluidically arranged immediately upstream of the compressor outlet 84, and which comprises an oil separator 88. The oil separator 88 is designed as a cyclone separator, wherein the refrigerant flows through the oil separator 88 to the compressor outlet 84, and the oil dissolved from the refrigerant settles at the bottom of the oil separation chamber 86, i.e., at the lowest point of the oil separation chamber 86.

For discharging the oil settled in the oil separation chamber 86, an inlet 89 of an oil return channel 90 is provided at the bottom of the oil separation chamber 86, which fluidically connects the oil separation chamber 86, and thus the high-pressure chamber 80, with a low-pressure chamber 87, wherein the motor chamber 18 forms the low-pressure chamber 87. The oil return channel 90 extends through the third compressor housing part 16, the fixed scroll 62, and through the second compressor housing part 14, wherein a filter 130 is arranged in the oil return channel 90.

The back-pressure chamber 82 is defined by the second compressor housing part 14 and the orbiting displacement scroll 60, wherein the existing pressure in the back-pressure chamber 82 acts on the axially displaceable orbiting displacement scroll 60, resulting in an axial load on the displacement scroll. This axial load leads to an improved seal between the end faces of the orbiting displacement scroll 60 and the fixed scroll 62. The back-pressure chamber 82 is fluidically connected to the high-pressure chamber 80 via a gas connecting channel 100. The gas connecting channel 100 extends from the high-pressure chamber 80 through the fixed scroll 62 and through the second compressor housing part 14. A gas connecting throttle is arranged in the gas connecting channel 100, which controls the mass flow of the gas flowing into the back-pressure chamber 82.

Figure 2:
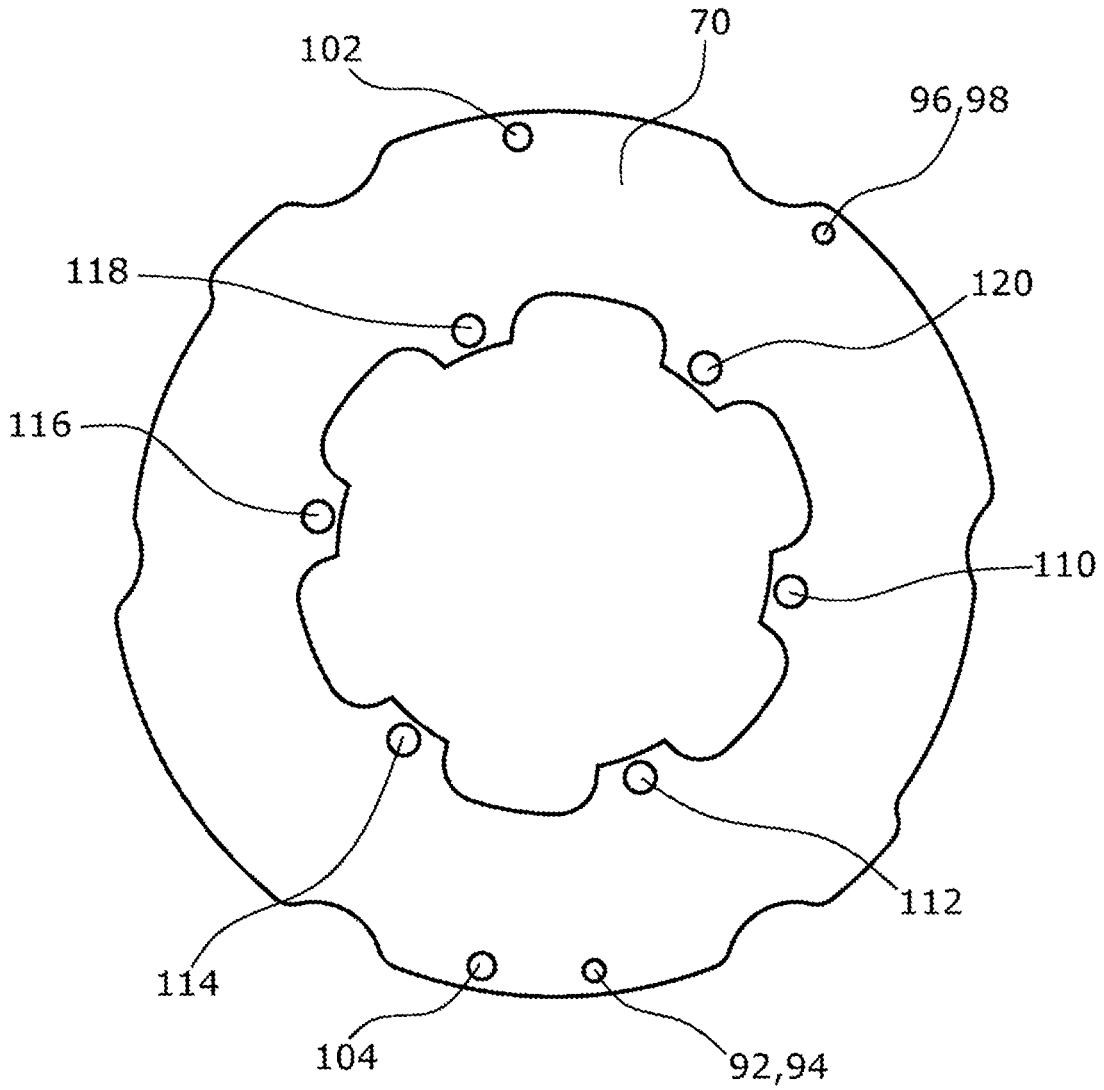
FIG. 2 shows a top view of a sliding disk of the scroll compressor of FIG. 1.

According to the present invention, the oil return channel 90 and the gas connecting channel 100 extend through the sliding disk 70 arranged between the second compressor housing part 14 and the fixed scroll 62, wherein the sliding disk 70, which is shown in FIG. 2, comprises an oil return throttle 92 and a gas connecting throttle 96.

For this purpose, the sliding disk 70 comprises a first bore 94 in its radially outer region and a second bore 98 spaced apart from the first bore 94 in the circumferential direction. The first bore 94 comprises a smaller diameter than the other sections of the oil return channel 90, so that the first bore 94 forms the oil return throttle 92. The second bore 98 comprises a smaller diameter than the other portions of the gas connecting channel 100, so that the second bore 98 forms the gas connecting throttle 96. The oil return throttle 92 thus controls the mass flow of oil through the oil return channel 90, and the gas connecting throttle 96 controls the mass flow of gas into the back-pressure chamber 82.

The sliding disk 70 further comprises two fixing openings 102, 104 in the radially outer region and six guide openings 110, 112, 114, 116, 118, 120 in the radially inner region, wherein the fixing openings 102, 104 and the guide openings 110, 112, 114, 116, 118, 120 comprise a substantially larger diameter than the bores 94, 98. A fixing pin 103 attached to the second compressor housing part 14 interacts with each of the fixing openings 102, 104, thereby fixing the sliding disc 70 perpendicular to a longitudinal axis 106 of the scroll compressor 2. A guide pin 122 attached to the second compressor housing part 14 penetrates each of the six guide openings 110, 112, 114, 116, 118, 120, wherein the guide pins 122 eccentrically interact with a respective guide bore 124 provided on the orbiting displacement scroll 60. The guide bores 124 comprise a larger diameter than the guide pins 122, wherein the guide pins 122 slide against the respective inner circumferential surface of the guide bore 124 during an orbiting movement of the orbiting displacement scroll 60. To reduce friction between the guide pins 122 and the orbiting displacement scroll 60, a plain bearing sleeve 126 is arranged in each of the guide bores 124.

A scroll compressor 2 is thus provided which can be manufactured with a reduced manufacturing and assembly effort, wherein the oil return throttle 92 and the gas connecting throttle 96 are provided in a simple and cost-efficient manner by the sliding disk 70, and no additional components and associated manufacturing and assembly steps are required.

It should be clear that the scope of protection of the present invention is not limited to the described embodiment, but that various modifications thereof are also conceivable. The sliding disk 70, the compressor housing 10, or the compressor unit 58 can, for example, be designed differently. Reference should also be had to the appended claims.

LIST OF REFERENCE NUMERALS

2 Scroll compressor
10 Compressor housing
12 First compressor housing part
14 Second compressor housing part
16 Third compressor housing part
18 Motor chamber
20 Compressor chamber
22 Electric motor
24 Stator
26 Rotor
28 Rotor shaft
29 Central orifice
30 First end shaft bearing section
34 Second end shaft bearing section
40 First shaft bearing
42 Second shaft bearing
43 Shaft ring
50 Eccentric unit
58 Compressor unit
60 Orbiting displacement scroll
62 Fixed scroll
63 Compression chamber
64 Eccentric shaft bearing
66 Radially outer inlet
68 Radially inner outlet
70 Sliding disk
80 High-pressure chamber
82 Back-pressure chamber
84 Compressor outlet
85 Compressor inlet
86 Oil separation chamber
87 Low-pressure chamber
88 Oil separator
89 Inlet (of oil return channel 90)
90 Oil return channel
92 Oil return throttle
94 First bore
96 Gas connecting throttle
98 Second bore
100 Gas connecting channel
102 Fixed opening
103 Fixing pin
104 Fixed opening
106 Longitudinal axis
110 Guide opening
112 Guide opening
114 Guide opening
116 Guide opening
118 Guide opening
120 Guide opening
122 Guide pin
124 Guide bore
126 Plain bearing sleeve
130 Filter
140 Circumferential groove
142 Sliding ring

What is claimed is:

1. A scroll compressor comprising:
a compressor housing;
a high-pressure chamber;
a low-pressure chamber;
an oil return channel comprising an oil return throttle arranged therein, the oil return channel being configured to fluidically connect the high-pressure chamber with the low-pressure chamber;
a driven eccentric unit;
a fixed scroll;
an orbiting displacement scroll arranged on the driven eccentric unit which interacts with the fixed scroll;
a sliding disk arranged between the orbiting displacement scroll and the compressor housing;
a back-pressure chamber arranged adjacent to the orbiting displacement scroll; and
a gas connecting channel comprising a gas connecting throttle arranged therein, the gas connecting channel being configured to fluidically connect the back-pressure chamber with the high-pressure chamber,
wherein
at least one of the oil return channel and the gas connecting channel extends through the sliding disk, and
the sliding disk comprises at least one of the oil return throttle and the gas connecting throttle.

2. The scroll compressor as recited in claim 1, wherein,
the oil return throttle or the gas connecting throttle is provided as a bore on the sliding disk, and
the bore has a diameter which is smaller than a diameter of the oil return channel or of the gas connecting channel.

3. The scroll compressor as recited in claim 1, wherein at least one of,
the oil return channel further extends at least in sections through the fixed scroll, and
the gas connecting channel further extends at least in sections through the fixed scroll.

4. The scroll compressor as recited in claim 3, wherein the gas connecting channel further extends from the high-pressure chamber, via a gas channel in the fixed scroll, through the sliding disk, and, via a gas channel in the compressor housing, to the back-pressure chamber.

5. The scroll compressor as recited in claim 3, wherein the oil return channel further extends from the high-pressure chamber, via an oil channel in the fixed scroll, through the sliding disk, and, via an oil channel in the compressor housing, to the low-pressure chamber.

6. The scroll compressor as recited in claim 1, wherein,
the high-pressure chamber comprises an oil separation chamber having an oil separator arranged therein, and
the oil return channel further comprises an inlet which is arranged at a lowest point of the oil separation chamber.

7. The scroll compressor as recited in claim 6, wherein the gas connecting channel further comprises an inlet which is arranged upstream of the oil separator in a gas flow direction.

8. The scroll compressor as recited in claim 1, further comprising:
a filter which is arranged in at least one of the oil return channel and the gas connecting channel.

9. The scroll compressor as recited in claim 1, further comprising:
a sliding ring,
wherein,
the orbiting displacement scroll comprises, on a side facing the sliding disk, a circumferential groove, and
the sliding ring is arranged in the circumferential groove so as to be in contact with the sliding disk.

10. The scroll compressor as recited in claim 1, further comprising:
a longitudinal axis,
wherein,
the sliding disc is interlockingly connected to the compressor housing perpendicular to the longitudinal axis.

11. The scroll compressor as recited in claim 10, wherein, the compressor housing comprises at least one fixing pin, and the sliding disc further comprises a fixing opening corresponding to each of the at least one fixing pin.

12. The scroll compressor as recited in claim 11, further comprising:

at least one guide pin, wherein, the sliding disc further comprises at least one guide opening through which a respective one of the at least one guide pin extends, and each of the at least one guide pin is fixed to the compressor housing so as to guide the orbiting displacement scroll.

13. The scroll compressor as recited in claim 12, wherein at least one of the oil return throttle and the gas connecting throttle comprises a diameter which is a multiple smaller than a diameter of the at least one fixing pin or of the at least one guide pin.

14. The scroll compressor as recited in claim 1, further comprising:

an electric motor comprising a rotor shaft which comprises a rotor, the electric motor being arranged in the low-pressure chamber, wherein, the orbiting displacement scroll is connected, via the driven eccentric unit, to the rotor shaft.

* * * * *